US008384746B2

(12) United States Patent
Wan et al.

(10) Patent No.: US 8,384,746 B2
(45) Date of Patent: Feb. 26, 2013

(54) COLOR MANAGEMENT METHOD AND DEVICE

(75) Inventors: Lifang Wan, Beijing (CN); Lilei Zhang, Beijing (CN); Xingxing Zhao, Beijing (CN); Qingjiang Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 295 days.

(21) Appl. No.: 12/944,919

(22) Filed: Nov. 12, 2010

(65) Prior Publication Data

US 2011/0115836 A1 May 19, 2011

(30) Foreign Application Priority Data

Nov. 13, 2009 (CN) ..... 2009 1 0237898

(51) Int. Cl.
*G09G 5/10* (2006.01)
*G09G 3/36* (2006.01)
*G09G 3/30* (2006.01)

(52) U.S. Cl. ..... 345/691; 345/102; 345/77

(58) Field of Classification Search ..... 345/102, 345/643, 644, 690–698
See application file for complete search history.

(56) References Cited

U.S. PATENT DOCUMENTS

2006/0262078 A1* 11/2006 Inuzuka et al. ..... 345/102
2008/0180384 A1* 7/2008 Aoki et al. ..... 345/102
2009/0153447 A1* 6/2009 Mizusako et al. ..... 345/77

* cited by examiner

*Primary Examiner* — Alexander Eisen
*Assistant Examiner* — Amit Chatly
(74) *Attorney, Agent, or Firm* — Ladas & Parry LLP

(57) ABSTRACT

The embodiments of the present invention relate to a color management method and device, the method comprises: RGB values is acquired from image signal inputted from external device; the corresponding transmittance of red pixel, transmittance of green pixel, and transmittance of blue pixel are calculated with an formula according to said RGB values and pre-stored system transition matrix with standard transition matrix; a control signal to control a driving voltage and/or luminance of light source corresponding to the red, green and blue pixels of the display device is generated according to the calculated transmittance of red pixel, transmittance of green pixel, and transmittance of blue pixel, so as to control the display device to perform the color display. The color management method enables the display device to accurately restore the reproduction color information, thereby effectively solving the color distortion problem of the display device.

16 Claims, 2 Drawing Sheets

COLOR MANAGEMENT METHOD AND DEVICE

BACKGROUND

The embodiments of the present invention relate to a color management technology, in particular to a color management method and device.

With the widely usage of various newly emerging input/output devices for digital color image, such as color scanner, digital camera, display device, color printer, etc., a color distortion issue during the transmission and duplicating reproduction among various devices for color image increasingly causes attention.

To solve the distortion issue when the color information is transferred among different devices, it has been proposed a Color Management Module (CMM) technology to correct the image data according to the color reproduction characteristic of respective image device, CMM technology is a technology to perform color conversion from a color space of a source device to a color space of any target device, for accurately transferring color. The currently available CMM products mainly are: "Adobe CMM", "Agfa CMM", "Apple CMM", "Heidelberg CMM", "Imation CMM", "Kodak CMM" and "X-Rite CMM" etc. The content of color management comprises device calibration, characteristic description and color conversion. Device calibration is precondition to ensure the normal operation of a system; the description of the device characteristic is the description for the color expression ability and the rendered color range of different devices; the color conversion is to convert a color space of one device into a color space of another device under the identical condition, to build a corresponding color mapping among different color spaces.

The color space could be classified as three categories: Red Green Blue (RGB) type of color space/computer graphic color space, which is mainly used for color display system of television (TV) and computer, for example, color spaces such as "HIS", "HSL", and "HSV" and so on. The standard Red Green Blue (sRGB) color space, which is a standard RGB color space, is used for color data standardized exchange in multimedia systems and devices such as computer, internet and so on. "XYZ" type of color space/International Commission on Illumination (CIE) color space is a color space independently of the device, for example, color spaces as "CIE 1931 XYZ", "L*a*b", "L*u*v" and "LCH" and so on. "YUV" type of color space/TV system color space could effectively transfer color TV image by compressing chroma information, such as color spaces as "YUV", "YIQ" and "SMPTE-240M Y'PbPr" etc., while "YUV" color space and "YIQ" color space are used in the TV signals of Phase Alternating Line (PAL) and National Television Standards Committee (NTSC) TV system, respectively.

FIG. 1 is a color gamut comparison graph of three principal colors Light Emitting Diode (LED) backlight with sRGB color space and "YIQ" color space of NTSC TV system. The color gamut is color expression capability, which is also the color range contained in color space. The abscissa represents red (X), the ordinate represents green (Y), wherein VA represents a visual area of human eyes, sRGB represents a sRGB color space used for multimedia systems and devices such as computer, internet and so on, RGB LED represents the color gamut of three principal colors LED backlight, NTSC represents the "YIQ" color space of NTSC TV system. As can be seen from FIG. 1, the color gamut of three principal colors LED backlight is far beyond that of sRGB color space and "YIQ" color space of NTSC TV system.

In order to convert the color space of input image signal into the color space of the display device so as to render the color in the display device, the provided color management methods in the existing art include a conventional look-up table method or a neural network algorithm. For example, the conversion computation from sRGB, "YUV" or "YIQ" color space and so on to the RGB color space of the display device is achieved by using "a tone matrix model" or "a matrix look-up table model", and then the colors are rendered based on the RGB values of the color space of the display device.

In the process of implementing the embodiments of the present invention, the inventor has found at least the following problems existing in the prior art: currently the color gamut of three principal colors LED backlight is far beyond that of sRGB color space, "YIQ" color space, "YUV" color space and so on, and when the color gamut of input color signal is less than that of the display device reproducing said color signal, the color expression capability of the display device could not be fully utilized, at the same time, it makes the errors occur between the color space of the input color signal and that of the display device during a match process therebetween. Thus in a regular three principal colors LED backlight TV, it is always found a problem that the color is over bright, which in the distortion in red area is particularly more severe, which causes not accurately reproducing the color.

SUMMARY

The embodiments of the present invention provide a color management method and device, in order to enable the display device to accurately restore the reproduction color information, thereby effectively solving the color distortion problem of the display device.

An embodiment of the present invention provides a color management method, comprising:

acquiring red, green, and blue RGB values from an image signal inputted from an external device;

calculating the corresponding transmittance of red pixel, transmittance of green pixel, and transmittance of blue pixel with following formula according to said RGB values, and a pre-stored system transition matrix and a standard transition matrix:

$$\begin{bmatrix} T_r \\ T_g \\ T_b \end{bmatrix} = \begin{bmatrix} C_R & C_G & C_B \\ L_R & L_G & L_B \\ M_R & M_G & M_B \end{bmatrix}^{-1} * M * \begin{bmatrix} R \\ G \\ B \end{bmatrix}$$

wherein $$\begin{bmatrix} R \\ G \\ B \end{bmatrix}$$

denotes RGB values, $$\begin{bmatrix} T_r \\ T_g \\ T_b \end{bmatrix}$$

denotes the transmittance of red pixel, transmittance of green pixel, and transmittance of blue pixel, $$\begin{bmatrix} C_R & C_G & C_B \\ L_R & L_G & L_B \\ M_R & M_G & M_B \end{bmatrix}$$

denotes said system transition matrix, which is a transition matrix between the transmittance of red pixel, transmittance of green pixel and transmittance of blue pixel and tristimulus values of a target system, M denotes said standard transition matrix, which is a transition matrix between said tristimulus values and said RGB values, and each of matrix dot elements in the system transition matrix and the standard transition matrix is a set constant; and generating a control signal to control a driving voltage and/or luminance of light source corresponding to the red, green and blue pixels of the display device according to the calculated transmittance of red pixel, transmittance of green pixel, and transmittance of blue pixel, so as to control the display device to perform the color display.

An embodiment of the present invention also provides a color management device, comprising:

an input unit, for acquiring red, green, and blue RGB values from an image signal inputted from an external device;

a base matrix storage unit, for storing a system transition matrix and a standard transition matrix, wherein said system transition matrix is a transition matrix between transmittance of red pixel, transmittance of green pixel, and transmittance of blue pixel and tristimulus values of a target system, said standard transition matrix is a transition matrix between said tristimulus values and said RGB values, and each of matrix dot elements in the system transition matrix and in the standard transition matrix is a set constant;

a correction unit, for calculating the corresponding transmittance of red pixel, transmittance of green pixel, and transmittance of blue pixel with following formula according to the RGB values, the system transition matrix and the standard transition matrix:

$$\begin{bmatrix} T_r \\ T_g \\ T_b \end{bmatrix} = \begin{bmatrix} C_R & C_G & C_B \\ L_R & L_G & L_B \\ M_R & M_G & M_B \end{bmatrix}^{-1} * M * \begin{bmatrix} R \\ G \\ B \end{bmatrix}$$

wherein $$\begin{bmatrix} R \\ G \\ B \end{bmatrix}$$

denotes the RGB values, $$\begin{bmatrix} T_r \\ T_g \\ T_b \end{bmatrix}$$

denotes the transmittance of red pixel, transmittance of green pixel, and transmittance of blue pixel, $$\begin{bmatrix} C_R & C_G & C_B \\ L_R & L_G & L_B \\ M_R & M_G & M_B \end{bmatrix}$$

denotes said system transition matrix, and M denotes said standard transition matrix; and a control unit, for generating a control signal to control a driving voltage and/or luminance of light source corresponding to the red, green and blue pixels of the display device according to the calculated transmittance of red pixel, transmittance of green pixel, and transmittance of blue pixel, so as to control the display device to perform the color display.

As seen from the above technical solutions, an embodiment of the presenting invention calculates the transmittance of red pixel, transmittance of green pixel, and transmittance of blue pixel of the display device by using RGB values of the input image signal and pre-stored system transition matrix and standard transition matrix, and adjusts the driving voltages and/or luminance of light source corresponding to red pixel, green pixel and blue pixel of the display device in real time through the control signal. Since in the embodiments of the present invention, the display device displays the color according to the RGB values of the input image signal, instead of changing the input RGB values for the transition of color spaces and displaying the color according to changed RGB values, the generated issue of departure from the original input color due to the transition of the color spaces would be overcome when the gamut of the display device is more than that of the input signal, thereby enabling the display device to accurately restore the reproduction input color signal.

DETAILED DESCRIPTION OF THE PREFERRED EMBODIMENTS

The embodiments of the present invention are described in details below in connection with the accompany figures and the certain embodiments.

First Embodiment

Figure 1:
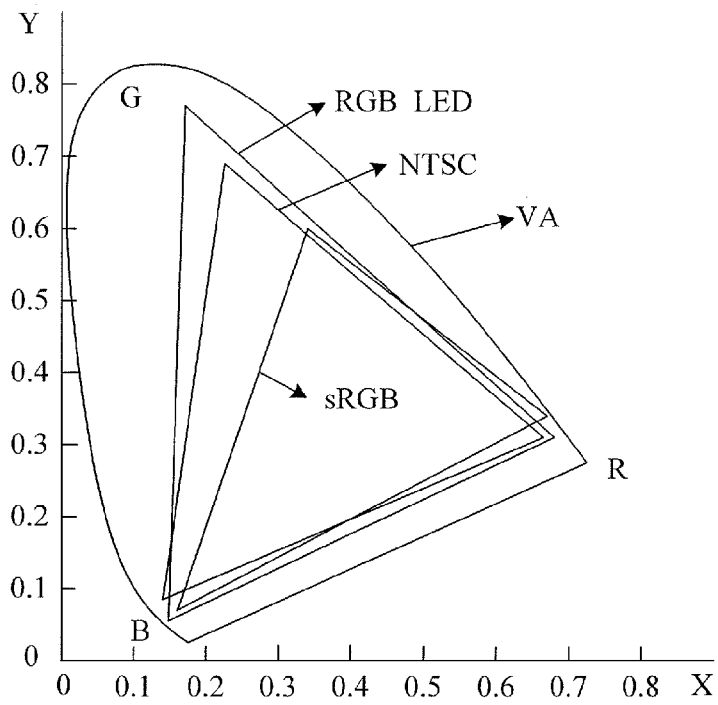
FIG. 1 is a color gamut comparison graph of three principal colors LED backlight with sRGB color space and "YIQ" color space of NTSC TV system in prior art.
Figure 2:
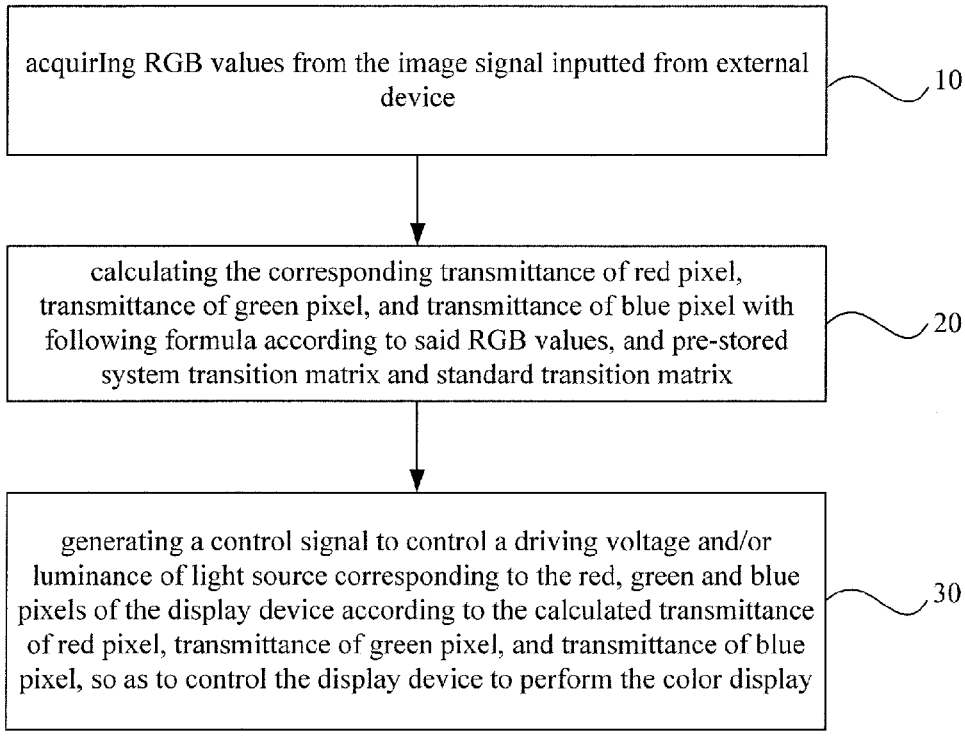
FIG. 2 is a flow chart of a color management method provided in a first embodiment of present invention.

FIG. 2 is a flow chart of a color management method provided in a first embodiment of present invention, the particular steps are:

Step 10, RGB values $$\begin{bmatrix} R \\ G \\ B \end{bmatrix}$$

is acquired from the image signal inputted from external device;

Step 20, corresponding transmittance of red pixel, transmittance of green pixel, and transmittance of blue pixel $$\begin{bmatrix} T_r \\ T_g \\ T_b \end{bmatrix}$$

are calculated with formula (1) according to the RGB values $$\begin{bmatrix} R \\ G \\ B \end{bmatrix}$$

and a system transition matrix $$\begin{bmatrix} C_R & C_G & C_B \\ L_R & L_G & L_B \\ M_R & M_G & M_B \end{bmatrix}$$

with a standard transition matrix M:

$$\begin{bmatrix} T_r \\ T_g \\ T_b \end{bmatrix} = \begin{bmatrix} C_R & C_G & C_B \\ L_R & L_G & L_B \\ M_R & M_G & M_B \end{bmatrix}^{-1} * M * \begin{bmatrix} R \\ G \\ B \end{bmatrix} \quad (1)$$

wherein the system transition matrix $$\begin{bmatrix} C_R & C_G & C_B \\ L_R & L_G & L_B \\ M_R & M_G & M_B \end{bmatrix}$$

is a transition matrix between transmittance of red pixel, transmittance of green pixel, and transmittance of blue pixel $$\begin{bmatrix} T_r \\ T_g \\ T_b \end{bmatrix}$$

and tristimulus values $$\begin{bmatrix} X \\ Y \\ Z \end{bmatrix}$$

of a target system, the target system is the "CIE-XYZ" system adopted by CIE; the standard transition matrix M is a transition matrix between tristimulus values $$\begin{bmatrix} X \\ Y \\ Z \end{bmatrix}$$

and the RGB values $$\begin{bmatrix} R \\ G \\ B \end{bmatrix},$$

wherein each of matrix dot elements $C_R$, $C_G$, $C_B$, $L_R$, $L_G$, $L_B$, $M_R$, $M_G$ and $M_B$ in the system transition matrix $$\begin{bmatrix} C_R & C_G & C_B \\ L_R & L_G & L_B \\ M_R & M_G & M_B \end{bmatrix},$$

and each of matrix dot elements in the standard transition matrix M could be set constants, which could be set in advance according to the experience value or a computation value.

Step 30, a control signal to control a driving voltage and/or luminance of light source corresponding to the red, green and blue pixels of the display device is generated according to the calculated transmittance of red pixel, transmittance of green pixel, and transmittance of blue pixel $$\begin{bmatrix} T_r \\ T_g \\ T_b \end{bmatrix},$$

so as to control the display device to perform the color display;

In step 30, the control signals to control the red, green and blue pixels of the display device could be generated according to the calculated transmittance of red pixel, transmittance of green pixel, and transmittance of blue pixel, respectively, the driving voltage corresponding to the pixel is a electric field voltage applied at both ends of the pixel, which corresponds to the gray scale rendered by the controllable pixel, the control signal of luminance of light source corresponding to the pixel is to control the luminance of light source, for example, the control signal of luminance of light source could be a Pulse Width Modulation (PWM) signal for controlling the luminance of the red, green and blue LEDs of the display device.

As for the liquid crystal display device (LCD), the above described driving voltage is inputted to a data driving circuit of the liquid crystal panel, the data driving circuit provides the driving voltage corresponding to the pixel to the pixel, so as to control the transmittance of the pixel, thus enabling the red sub pixel, green sub pixel and blue sub pixel of the LCD device to change the transmittance in real time in accordance with the control signal, thereby achieving the purpose of accurately reproducing the color information.

As for three principal colors LED backlight display device, the aforementioned control signal of luminance of light source is inputted to a light source driving unit of the three principal colors LED backlight module. The light source driving unit provides a PWM signal with a certain PWM value to a light source unit, so as to control the luminance of the red LED, green LED and blue LED, thus enabling the red pixel, green pixel and blue pixel of the three principal colors LED backlight display device to change the transmittance in real time in accordance with the control signal, thereby achieving the purpose of accurately reproducing the color information.

As for the aforementioned three principal colors LED backlight display device, it is also possible to synthetically adjust the PWM values of the red LED, green LED and blue LED and the driving voltage values of red pixel, green pixel and blue pixel, thus enabling the red pixel, green pixel and blue pixel of the three principal colors LED backlight display device change the transmittance in real time in accordance with the control signal, thereby achieving the purpose of accurately reproducing the color information.

As for Cathode Ray Tube (CRT) display device, it could change the transmittance of the red pixel, green pixel and blue pixel in real time through the control of a gamma circuit, thereby achieving the purpose of accurately reproducing the color information.

On the basis of aforementioned technical solutions, in order to correct the error resulting between the device and system, it could introduce an error correction matrix when calculating the transmittance of the red, green and blue pixels by using formula (1), namely, multiplying the calculated red pixel transmittance, green pixel transmittance and blue pixel transmittance by the error correction matrix, so as to perform the error correction. That is, aforementioned formula (1) could be replaced with formula (2) as below to calculate the transmittance of the red, green and blue pixels:

$$\begin{bmatrix} T_r \\ T_g \\ T_b \end{bmatrix} = \begin{bmatrix} x1 & x2 & x3 \\ y1 & y2 & y3 \\ z1 & z2 & z3 \end{bmatrix} \begin{bmatrix} C_R & C_G & C_B \\ L_R & L_G & L_B \\ M_R & M_G & M_B \end{bmatrix}^{-1} * M * \begin{bmatrix} R \\ G \\ B \end{bmatrix} \tag{2}$$

Wherein, each of matrix dot elements x1, x2, x3, y1, y2, y3, z1, z2 and z3 in the error correction matrix $$\begin{bmatrix} x1 & x2 & x3 \\ y1 & y2 & y3 \\ z1 & z2 & z3 \end{bmatrix}$$

could be set constants, which could be determined according to the actual test results of the system. The particular method is that the actual test value of the corresponding tristimulus values when the RGB values is $$\begin{bmatrix} 255 \\ 0 \\ 0 \end{bmatrix}$$

is set as $$\begin{bmatrix} X1' \\ Y1' \\ Z1' \end{bmatrix},$$

the actual test values of the corresponding tristimulus values when the RGB values is $$\begin{bmatrix} 0 \\ 255 \\ 0 \end{bmatrix}$$

is set as $$\begin{bmatrix} X2' \\ Y2' \\ Z2' \end{bmatrix},$$

the actual test values of the corresponding tristimulus values when the RGB values is $$\begin{bmatrix} 0 \\ 0 \\ 255 \end{bmatrix}$$

is set as $$\begin{bmatrix} X3' \\ Y3' \\ Z3' \end{bmatrix},$$

at this time, since the corresponding $$\begin{bmatrix} T_r \\ T_g \\ T_b \end{bmatrix}$$

when the RGB values is $$\begin{bmatrix} 255 \\ 0 \\ 0 \end{bmatrix} \text{ is } \begin{bmatrix} 1 \\ 0 \\ 0 \end{bmatrix},$$

the corresponding $$\begin{bmatrix} T_r \\ T_g \\ T_b \end{bmatrix}$$

when the RGB values is $$\begin{bmatrix} 0 \\ 255 \\ 0 \end{bmatrix} \text{ is } \begin{bmatrix} 0 \\ 1 \\ 0 \end{bmatrix},$$

the corresponding $$\begin{bmatrix} T_r \\ T_g \\ T_b \end{bmatrix}$$

when the RGB values is $$\begin{bmatrix} 0 \\ 0 \\ 255 \end{bmatrix} \text{ is } \begin{bmatrix} 0 \\ 0 \\ 1 \end{bmatrix},$$

the tristimulus values' theoretical values $$\begin{bmatrix} X1 \\ Y1 \\ Z1 \end{bmatrix}, \begin{bmatrix} X2 \\ Y2 \\ Z2 \end{bmatrix} \text{ and } \begin{bmatrix} X3 \\ Y3 \\ Z3 \end{bmatrix}$$

could be calculated according to formula (3), respectively, $$\begin{bmatrix} C_R & C_G & C_B \\ L_R & L_G & L_B \\ M_R & M_G & M_B \end{bmatrix} * \begin{bmatrix} T_r \\ T_g \\ T_b \end{bmatrix} = \begin{bmatrix} X \\ Y \\ Z \end{bmatrix} \tag{3}$$

Since the aforementioned tristimulus value's actual test values $$\begin{bmatrix} X' \\ Y' \\ Z' \end{bmatrix}$$

and theory values $$\begin{bmatrix} X \\ Y \\ Z \end{bmatrix}$$

meet the relation $$\begin{bmatrix} X \\ Y \\ Z \end{bmatrix} = \begin{bmatrix} x1 & x2 & x3 \\ y1 & y2 & y3 \\ z1 & z2 & z3 \end{bmatrix} * \begin{bmatrix} X' \\ Y' \\ Z' \end{bmatrix},$$

the following matrix formulae could be obtained:

$$\begin{bmatrix} X1 \\ Y1 \\ Z1 \end{bmatrix} = \begin{bmatrix} x1 & x2 & x3 \\ y1 & y2 & y3 \\ z1 & z2 & z3 \end{bmatrix} * \begin{bmatrix} X1' \\ Y1' \\ Z1' \end{bmatrix},$$

$$\begin{bmatrix} X2 \\ Y2 \\ Z2 \end{bmatrix} = \begin{bmatrix} x1 & x2 & x3 \\ y1 & y2 & y3 \\ z1 & z2 & z3 \end{bmatrix} * \begin{bmatrix} X2' \\ Y2' \\ Z2' \end{bmatrix},$$

and $$\begin{bmatrix} X3 \\ Y3 \\ Z3 \end{bmatrix} = \begin{bmatrix} x1 & x2 & x3 \\ y1 & y2 & y3 \\ z1 & z2 & z3 \end{bmatrix} * \begin{bmatrix} X3' \\ Y3' \\ Z3' \end{bmatrix},$$

then the error correction matrix $$\begin{bmatrix} x1 & x2 & x3 \\ y1 & y2 & y3 \\ z1 & z2 & z3 \end{bmatrix}$$

could be calculated through those three matrix formulae.

Second Embodiment

Figure 3:
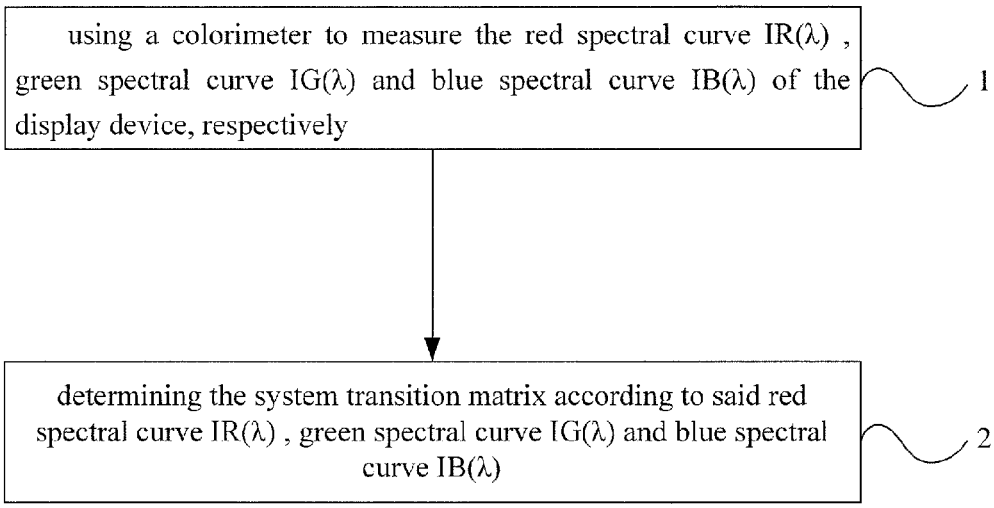
FIG. 3 is a flow chart of a method to determine the system transition matrix in a color management method provided in a second embodiment of present invention.

FIG. 3 is a flow chart of a method to determine the system transition matrix in a color management method provided in a second embodiment of present invention. In order to determine said system transition matrix, following steps can also be performed before the step 20:

Step 1, a colorimeter is used to measure the red spectral curve IR(λ), green spectral curve IG(λ) and blue spectral curve IB(λ) of the display device, respectively, in particular, the gray scale of the display device could be adjusted to (255, 0, 0), (0, 255, 0) and (0, 0, 255), respectively, and then each color spectral curve could be measured by using the colorimeter, respectively, the spectral test could be performed every 1 nm, 5 nm or 10 nm from 380 nm to 780 nm to obtain the spectral curve.

Step 2, the system transition matrix is determined according to the red spectral curve IR(λ), green spectral curve IG(λ) and blue spectral curve IB(λ).

The detailed determination method of step 2 is as follows, the transmittance $T_r$ of the red pixel of the display device is equal to the ratio between the actual transmission luminance of the red pixel and the transmission luminance of the red pixel at (255, 0, 0), the transmittance $T_g$ of the green pixel of the display device is equal to the ratio between the actual transmission luminance of the green pixel and the transmission luminance of the green pixel at (0, 255, 0), the transmittance $T_b$ of the blue pixel of the display device is equal to the ratio between the actual transmission luminance of the blue pixel and the transmission luminance of the blue pixel at (0, 0, 255).

The target system, namely "CIE-XYZ" system, calculates the tristimulus values using the following formula (4):

$$X = k\int_{\lambda} \varphi(\lambda)\bar{x}(\lambda)d\lambda, \tag{4}$$

$$Y = k\int_{\lambda} \varphi(\lambda)\bar{y}(\lambda)d\lambda,$$

-continued $$Z = k\int_{\lambda}\varphi(\lambda)\bar{z}(\lambda)d\lambda,$$

Wherein, X, Y and Z denote tristimulus values, respectively, k=683 lm/W, denotes wavelength, $\phi(\lambda)$ is light source spectral, $\bar{x}(\lambda)$, $\bar{y}(\lambda)$, $\bar{z}(\lambda)$ is a set curve of a standard observer.

Since $\phi(\lambda)=IR(\lambda)*T_r+IG(\lambda)*T_g+IB(\lambda)*T_b$, the following formula (5) could be obtained by performing integral or summation on formula (4):

$$\begin{cases} k*\Delta\lambda\sum[IR(\lambda)*T_r+IG(\lambda)*T_g+IB(\lambda)*T_b]*\bar{x}(\lambda)=X \\ k*\Delta\lambda\sum[IR(\lambda)*T_r+IG(\lambda)*T_g+IB(\lambda)*T_b]*\bar{y}(\lambda)=Y \\ k*\Delta\lambda\sum[IR(\lambda)*T_r+IG(\lambda)*T_g+IB(\lambda)*T_b]*\bar{z}(\lambda)=Z \end{cases} \quad (5)$$

Formula (6) could be obtained by expanding and deforming the formula (5):

$$\begin{cases} k*\Delta\lambda\sum[IR(\lambda)*\bar{x}(\lambda)]*T_r+k*\Delta\lambda\sum[IG(\lambda)*\bar{x}(\lambda)]*T_g+k*\Delta\lambda\sum[IB(\lambda)*\bar{x}(\lambda)]*T_b=X \\ k*\Delta\lambda\sum[IR(\lambda)*\bar{y}(\lambda)]*T_r+k*\Delta\lambda\sum[IG(\lambda)*\bar{y}(\lambda)]*T_g+k*\Delta\lambda\sum[IB(\lambda)*\bar{y}(\lambda)]*T_b=Y \\ k*\Delta\lambda\sum[IR(\lambda)*\bar{z}(\lambda)]*T_r+k*\Delta\lambda\sum[IG(\lambda)*\bar{z}(\lambda)]*T_g+k*\Delta\lambda\sum[IB(\lambda)*\bar{z}(\lambda)]*T_b=Z \end{cases} \quad (6)$$

Formula (6) is a conversion formula between the transmittance of the red, green and blue pixels and tristimulus values, that is, it is equivalent to aforementioned formula (3), and the parameters in the formula (6) correspond to each of matrix dot elements in the system transition matrix, therefore $C_R=k*\Delta\lambda\Sigma[IR(\lambda)*\bar{x}(\lambda)]$, $C_G=k*\Delta\lambda\Sigma[IR(\lambda)*\bar{x}(\lambda)]$, $C_B=k*\Delta\lambda\Sigma[IR(\lambda)*\bar{x}(\lambda)]$, $L_R=k*\Delta\lambda\Sigma[IR(\lambda)*\bar{y}(\lambda)]$, $L_G=k*\Delta\lambda\Sigma[IR(\lambda)*\bar{y}(\lambda)]$, $L_B=k*\Delta\lambda\Sigma[IR(\lambda)*\bar{y}(\lambda)]$, $M_R=k*\Delta\lambda\Sigma[IR(\lambda)*\bar{z}(\lambda)]$, $M_G=k*\Delta\lambda\Sigma[IR(\lambda)*\bar{z}(\lambda)]$, $M_B=k*\Delta\lambda\Sigma[IR(\lambda)*\bar{z}(\lambda)]$, wherein k=683 lm/W, $\Delta\lambda=5$ nm or $\Delta\lambda=10$ nm, $\bar{x}(\lambda)$, $\bar{y}(\lambda)$ and $\bar{z}(\lambda)$ is a curve of a standard observer, the particular value of which could be obtained by looking up a table. In the embodiment, the value range of wavelength $\lambda$ is from 380 nm to 780 nm.

In aforementioned embodiments, the image signals inputted from external devices satisfy sRGB color space, or PAL and NTSC TV systems' color space.

Thus, based on the aforementioned solutions, the standard transition matrix M is determined as $$\begin{bmatrix} 0.430 & 0.342 & 0.178 \\ 0.222 & 0.707 & 0.071 \\ 0.020 & 0.130 & 0.939 \end{bmatrix},$$

when the image signal is recognized as PAL TV system.

The standard transition matrix M is determined as $$\begin{bmatrix} 0.607 & 0.174 & 0.200 \\ 0.299 & 0.587 & 0.114 \\ 0.000 & 0.066 & 1.116 \end{bmatrix},$$

when the image signal is recognized as NTSC TV system.

The standard transition matrix M is determined as $$\begin{bmatrix} 0.4124 & 0.3576 & 0.1805 \\ 0.2126 & 0.7152 & 0.0722 \\ 0.0193 & 0.1192 & 0.9505 \end{bmatrix},$$

when the image signal is recognized as sRGB color space.

However, the input image signal of the embodiment of the present invention is not limited to satisfy the above TV systems, it could also be a SMPTE-C TV system of the SMPTE (Society of Motion Picture and Television Engineers) or other standard TV system, in which case, only the standard transition matrix M need to be changed accordingly, for example, when the input image signal is SMPTE-C TV system, the value of M is $$\begin{bmatrix} 0.3935 & 0.3653 & 0.1916 \\ 0.2124 & 0.7011 & 0.0866 \\ 0.0187 & 0.1119 & 0.9582 \end{bmatrix}.$$

The color management method of the embodiments of the present invention could makes the liquid crystal display, LED display device or CRT display device to accurately reproduce sRGB color space or the color space of PAL, NTSC or SMPTE-C TV system and so on, thus effectively solving the color distortion problem of the display device.

The color management method of the embodiments of present invention is different from the conventional look-up table method or neural network algorithm in that, the algorithm used in this color management method is simpler since the transmittance of the red, green and blue pixels on the screen could be adjusted in real time by the RGB values of the input image signal, and it can be implemented just by hardware, the circuit control of which is easily implemented and has a higher precision.

Third Embodiment

Figure 4:
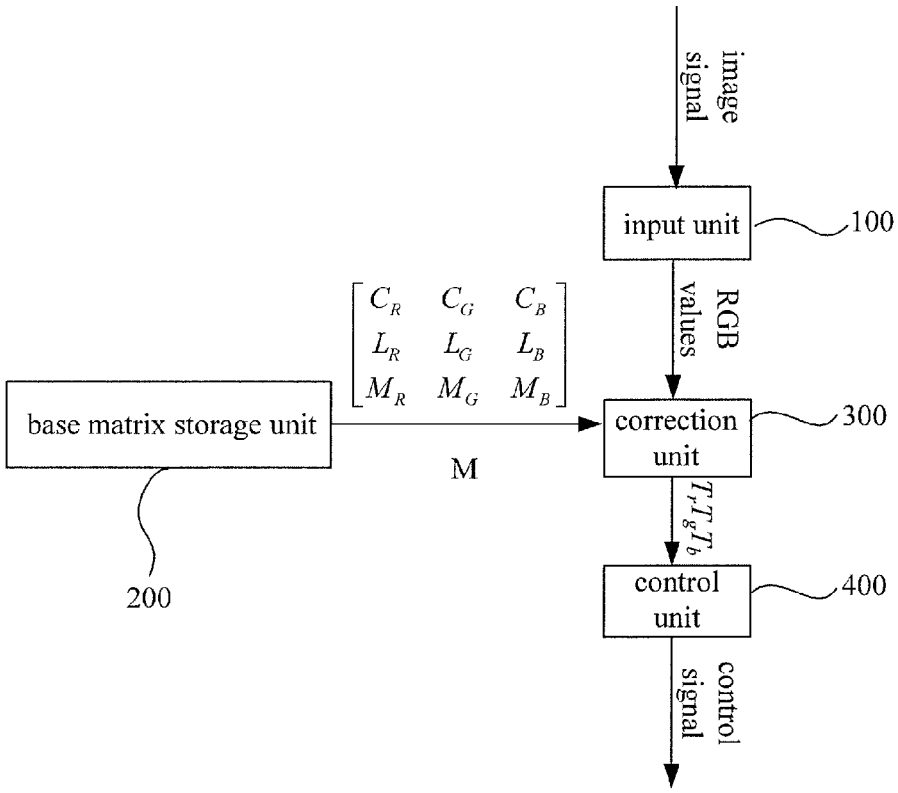
FIG. 4 is a configuration diagram of a color management device provided in a third embodiment of present invention.

FIG. 4 is a configuration diagram of a color management device provided in a third embodiment of present invention, said color management device comprises: an input unit 100, a base matrix storage unit 200, a correction unit 300 and a control unit 400.

The input unit 100 is used to obtain RGB values from image signal inputted from an external device.

The base matrix storage unit 200 is used to store system transition matrix and standard transition matrix, system transition matrix is a transition matrix between transmittance of red pixel, transmittance of green pixel, and transmittance of blue pixel and tristimulus values of a target system, the target system is the "CIE-XYZ" system; the standard transition matrix M is a transition matrix between tristimulus values and the RGB values, wherein each of matrix dot elements $C_R$, $C_G$, $C_B$, $L_R$, $L_G$, $L_B$, $M_R$, $M_G$ and $M_B$ in the system transition matrix $$\begin{bmatrix} C_R & C_G & C_B \\ L_R & L_G & L_B \\ M_R & M_G & M_B \end{bmatrix}$$

could be set constants, each of matrix dot elements in the standard transition matrix M could also be set constants.

The correction unit 300 is used to calculate the corresponding transmittance of red pixel, transmittance of green pixel, and transmittance of blue pixel with formula (7), according to RGB values and system transition matrix and standard transition matrix.

$$\begin{bmatrix} T_r \\ T_g \\ T_b \end{bmatrix} = \begin{bmatrix} C_R & C_G & C_B \\ L_R & L_G & L_B \\ M_R & M_G & M_B \end{bmatrix}^{-1} * M * \begin{bmatrix} R \\ G \\ B \end{bmatrix} \tag{7}$$

Wherein, $$\begin{bmatrix} R \\ G \\ B \end{bmatrix}$$

denotes RGB values, $$\begin{bmatrix} T_r \\ T_g \\ T_b \end{bmatrix}$$

denotes transmittance of red pixel, transmittance of green pixel, and transmittance of blue pixel.

The control unit 400 is used to generate a control signal to control a driving voltage and/or luminance of light source corresponding to the red, green and blue pixels of the display device according to the calculated transmittance of red pixel, transmittance of green pixel, and transmittance of blue pixel, so as to control the display device to perform the color display.

The color management device of the embodiments of the present invention, in addition to aforementioned input unit, transition matrix and standard transition matrix storage unit, correction unit and control unit being included therein, could further include an error correction matrix storage unit, which is used to store error correction matrix $$\begin{bmatrix} x1 & x2 & x3 \\ y1 & y2 & y3 \\ z1 & z2 & z3 \end{bmatrix},$$

wherein each of matrix dot elements x1, x2, x3, y1, y2, y3, z1, z2 and z3 in the error correction matrix could be set constants, which could be determined by referring to the aforementioned embodiments. At this time, correction unit could further multiply the calculated transmittance of red pixel, transmittance of green pixel, and transmittance of blue pixel by the error correction matrix, to perform error correction. That is, the above formula (7) could be replaced with following formula (8) to be executed.

$$\begin{bmatrix} T_r \\ T_g \\ T_b \end{bmatrix} = \begin{bmatrix} x1 & x2 & x3 \\ y1 & y2 & y3 \\ z1 & z2 & z3 \end{bmatrix} \begin{bmatrix} C_R & C_G & C_B \\ L_R & L_G & L_B \\ M_R & M_G & M_B \end{bmatrix}^{-1} * M * \begin{bmatrix} R \\ G \\ B \end{bmatrix} \tag{8}$$

The aforementioned error correction matrix could correct the errors resulted between devices and system.

On the basis of above solution, the color management device of the embodiment of the present invention could further include a transition matrix generation module, said transition matrix generation module comprises:

a colorimeter, which is used to measure the red spectral curve IR(λ), green spectral curve IG(λ) and blue spectral curve IB(λ) of the display device, respectively, when the gray scales of the display device are respective (255, 0, 0), (0, 255, 0) and (0, 0, 255);

a calculation unit, which is used to determine the system transition matrix $$\begin{bmatrix} C_R & C_G & C_B \\ L_R & L_G & L_B \\ M_R & M_G & M_B \end{bmatrix}$$

according to the red spectral curve IR(λ), green spectral curve IG(λ) and blue spectral curve IB(λ). The detailed determination method could refer to aforementioned embodiments.

As for LCD device, the aforementioned control signal of driving voltage of the control unit could adjust the transmittance of the red, green and blue sub pixels in real time by changing the driving voltages of the red sub pixel, green sub pixel and blue sub pixel, thereby achieving the purpose of accurately reproducing the color information.

As for three principal colors LED backlight display device, the aforementioned control signal of luminance of light source of the control unit could change the transmittance of the red, green and blue pixels in real time by changing the luminance of the red pixel, green pixel and blue pixel, thereby achieving the purpose of accurately reproducing the color information. The control signal of luminance of light source could be PWM.

As for the aforementioned three principal colors LED backlight display device, it is also possible to synthetically adjust the luminance values of the red LED, green LED and blue LED and the driving voltage values of red pixel, green pixel and blue pixel, so as to change the transmittance of the red, green and blue pixels in real time, thereby achieving the purpose of accurately reproducing the color information.

As for CRT display device, it could change the transmittance of the red pixel, green pixel and blue pixel in real time through the control of a gamma circuit, thereby achieving the purpose of accurately reproducing the color information.

According to the RGB values of the image signal inputted from the external device, the color management device of the embodiments of the present invention could adjust the voltages and/or luminance of light source of red, green and blue pixels of the display device in real time, such that the liquid crystal display, LED display device or CRT display device could accurately reproduce sRGB color space or the color space of PAL, NTSC or SMPTE-C TV system and so on, which can effectively solve the color distortion problem of the display device.

It will be understood by one of ordinary skill in the art, that implementing all or part of the steps of aforementioned method embodiments could be made by program instruction-related hardware, said program could be stored in a computer readable storage medium, the steps of aforementioned method embodiments will be executed when the program is executed; and aforementioned storage medium comprises: ROM, RAM, magnetic disk or optical disk etc. and various medium for storing program codes.

Finally, it should be noted that, the above embodiments are used only to explain the technical solution of the present invention, not to limit the invention; although the present invention has been described in details with reference to the aforementioned embodiments thereof, it would be obvious to those skilled in the art that he can still make variations to the technical solutions in aforementioned embodiments or make equal replacement for part of the technical features thereof, such variations or replacements are not to be regarded as rending the nature of the amended technical solutions departing from the spirit and scope of the invention.

What is claimed is:

1. A color management method, comprising the steps of:

acquiring red, green, and blue RGB values from an image signal inputted from an external device;

calculating the corresponding transmittance of red pixel, transmittance of green pixel, and transmittance of blue pixel with following formula according to said RGB values, and a pre-stored system transition matrix and a standard transition matrix:

$$\begin{bmatrix} T_r \\ T_g \\ T_b \end{bmatrix} = \begin{bmatrix} C_R & C_G & C_B \\ L_R & L_G & L_B \\ M_R & M_G & M_B \end{bmatrix}^{-1} * M * \begin{bmatrix} R \\ G \\ B \end{bmatrix}$$

wherein $$\begin{bmatrix} R \\ G \\ B \end{bmatrix}$$

denotes RGB values, $$\begin{bmatrix} T_r \\ T_g \\ T_b \end{bmatrix}$$

denotes the transmittance of red pixel, transmittance of green pixel, and transmittance of blue pixel, $$\begin{bmatrix} C_R & C_G & C_B \\ L_R & L_G & L_B \\ M_R & M_G & M_B \end{bmatrix}$$

denotes said system transition matrix, which is a transition matrix between the transmittance of red pixel, transmittance of green pixel and transmittance of blue pixel and tristimulus values of a target system, M denotes said standard transition matrix, which is a transition matrix between said tristimulus values and said RGB values, and each of matrix dot elements in the system transition matrix and the standard transition matrix is a set constant; and generating a control signal to control a driving voltage and/or luminance of light source corresponding to the red, green and blue pixels of the display device according to the calculated transmittance of red pixel, transmittance of green pixel, and transmittance of blue pixel, so as to control the display device to perform the color display.

2. The color management method as claimed in claim 1, after calculating the corresponding transmittance of red pixel, transmittance of green pixel, and transmittance of blue pixel with following formula according to said RGB values, and the pre-stored system transition matrix and the standard transition matrix, further comprising the step of:

multiplying the calculated red pixel transmittance, green pixel transmittance and blue pixel transmittance $$\begin{bmatrix} T_r \\ T_g \\ T_b \end{bmatrix}$$

by an error correction matrix $$\begin{bmatrix} x1 & x2 & x3 \\ y1 & y2 & y3 \\ z1 & z2 & z3 \end{bmatrix},$$

so as to perform the error correction, wherein each of matrix dot elements in the error correction matrix is a set constant.

3. The color management method as claimed in claim 1, before calculating the corresponding transmittance of red pixel, transmittance of green pixel, and transmittance of blue pixel with following formula according to said RGB values, and the pre-stored system transition matrix and the standard transition matrix, further comprising the step of:

using a colorimeter to measure the red spectral curve IR(λ), green spectral curve IG(λ) and blue spectral curve IB(λ) of the display device, respectively; and determining the system transition matrix according to said red spectral curve IR(λ), green spectral curve IG(λ) and blue spectral curve IB(λ).

4. The color management method as claimed in claim 1, wherein the step of generating a control signal to control the luminance of light source corresponding to the red, green and blue pixels of the display device according to the calculated transmittance of red pixel, transmittance of green pixel, and transmittance of blue pixel comprises:

generating a Pulse Width Modulation signal for controlling the luminance of the red, green and blue LEDs of the display device according to the calculated transmittance of red pixel, transmittance of green pixel, and transmittance of blue pixel, respectively.

5. The color management method as claimed in claim 1, before calculating the corresponding transmittance of red pixel, transmittance of green pixel, and transmittance of blue pixel with following formula according to said RGB values, and the pre-stored system transition matrix and the standard transition matrix, further comprising step of:

when the image signal is recognized as Phase Alternating Line TV system, the standard transition matrix being determined as $$\begin{bmatrix} 0.430 & 0.342 & 0.178 \\ 0.222 & 0.707 & 0.071 \\ 0.020 & 0.130 & 0.939 \end{bmatrix}.$$

6. The color management method as claimed in claim 1, before calculating the corresponding transmittance of red pixel, transmittance of green pixel, and transmittance of blue pixel with following formula according to said RGB values, and the pre-stored system transition matrix and the standard transition matrix, further comprising step of:

when the image signal is recognized as National Television Standards Committee TV system, the standard transition matrix being determined as $$\begin{bmatrix} 0.607 & 0.174 & 0.200 \\ 0.299 & 0.587 & 0.114 \\ 0.000 & 0.066 & 1.116 \end{bmatrix}.$$

7. The color management method as claimed in claim 1, before calculating the corresponding transmittance of red pixel, transmittance of green pixel, and transmittance of blue pixel with following formula according to said RGB values, and the pre-stored system transition matrix and the standard transition matrix, further comprising the step of:

when the image signal is recognized as standard Red Green Blue color space, the standard transition matrix being determined as $$\begin{bmatrix} 0.4124 & 0.3576 & 0.1805 \\ 0.2126 & 0.7152 & 0.0722 \\ 0.0193 & 0.1192 & 0.9505 \end{bmatrix}.$$

8. The color management method as claimed in claim 2, before calculating the corresponding transmittance of red pixel, transmittance of green pixel, and transmittance of blue pixel with following formula according to said RGB values, and the pre-stored system transition matrix and the standard transition matrix, further comprising the step of:

using a colorimeter to measure the red spectral curve IR(λ), green spectral curve IG(λ) and blue spectral curve IB(λ) of the display device, respectively; and determining the system transition matrix according to said red spectral curve IR(λ), green spectral curve IG(λ) and blue spectral curve IB(λ).

9. The color management method as claimed in claim 2, wherein the step of generating a control signal to control the luminance of light source corresponding to the red, green and blue pixels of the display device according to the calculated transmittance of red pixel, transmittance of green pixel, and transmittance of blue pixel comprises:

generating a Pulse Width Modulation signal for controlling the luminance of the red, green and blue LEDs of the display device according to the calculated transmittance of red pixel, transmittance of green pixel, and transmittance of blue pixel, respectively.

10. The color management method as claimed in claim 2, before calculating the corresponding transmittance of red pixel, transmittance of green pixel, and transmittance of blue pixel with following formula according to said RGB values, and the pre-stored system transition matrix and the standard transition matrix, further comprising the step of:

when the image signal is recognized as Phase Alternating Line TV system, the standard transition matrix being determined as $$\begin{bmatrix} 0.430 & 0.342 & 0.178 \\ 0.222 & 0.707 & 0.071 \\ 0.020 & 0.130 & 0.939 \end{bmatrix}.$$

11. The color management method as claimed in claim 2, before calculating the corresponding transmittance of red pixel, transmittance of green pixel, and transmittance of blue pixel with following formula according to said RGB values, and the pre-stored system transition matrix and the standard transition matrix, further comprising the step of:

when the image signal is recognized as National Television Standards Committee TV system, the standard transition matrix being determined as $$\begin{bmatrix} 0.607 & 0.174 & 0.200 \\ 0.299 & 0.587 & 0.114 \\ 0.000 & 0.066 & 1.116 \end{bmatrix}.$$

12. The color management method as claimed in claim 2, before calculating the corresponding transmittance of red pixel, transmittance of green pixel, and transmittance of blue pixel with following formula according to said RGB values, and the pre-stored system transition matrix and the standard transition matrix, further comprising the step of:

when the image signal is recognized as standard Red Green Blue color space, the standard transition matrix being determined as $$\begin{bmatrix} 0.4124 & 0.3576 & 0.1805 \\ 0.2126 & 0.7152 & 0.0722 \\ 0.0193 & 0.1192 & 0.9505 \end{bmatrix}.$$

13. A color management device, comprising:

an input unit, for acquiring red, green, and blue RGB values from an image signal inputted from an external device;

a base matrix storage unit, for storing a system transition matrix and a standard transition matrix, wherein said system transition matrix is a transition matrix between transmittance of red pixel, transmittance of green pixel, and transmittance of blue pixel and tristimulus values of a target system, said standard transition matrix is a transition matrix between said tristimulus values and said RGB values, and each of matrix dot elements in the system transition matrix and in the standard transition matrix is a set constant;

a correction unit, for calculating the corresponding transmittance of red pixel, transmittance of green pixel, and transmittance of blue pixel with following formula according to the RGB values, the system transition matrix and the standard transition matrix:

$$\begin{bmatrix} T_r \\ T_g \\ T_b \end{bmatrix} = \begin{bmatrix} C_R & C_G & C_B \\ L_R & L_G & L_B \\ M_R & M_G & M_B \end{bmatrix}^{-1} * M * \begin{bmatrix} R \\ G \\ B \end{bmatrix}$$

wherein $$\begin{bmatrix} R \\ G \\ B \end{bmatrix}$$

denotes the RGB values, $$\begin{bmatrix} T_r \\ T_g \\ T_b \end{bmatrix}$$

denotes the transmittance of red pixel, transmittance of green pixel, and transmittance of blue pixel, $$\begin{bmatrix} C_R & C_G & C_B \\ L_R & L_G & L_B \\ M_R & M_G & M_B \end{bmatrix}$$

denotes said system transition matrix, and M denotes said standard transition matrix; and a control unit, for generating a control signal to control a driving voltage and/or luminance of light source corresponding to the red, green and blue pixels of the display device according to the calculated transmittance of red pixel, transmittance of green pixel, and transmittance of blue pixel, so as to control the display device to perform the color display.

14. The color management device as claimed in claim 13, further comprising:

an error correction matrix storage unit, for storing an error correction matrix $$\begin{bmatrix} x1 & x2 & x3 \\ y1 & y2 & y3 \\ z1 & z2 & z3 \end{bmatrix},$$

and multiplying the calculated red pixel transmittance, green pixel transmittance and blue pixel transmittance $$\begin{bmatrix} T_r \\ T_g \\ T_b \end{bmatrix}$$

by the error correction matrix $$\begin{bmatrix} x1 & x2 & x3 \\ y1 & y2 & y3 \\ z1 & z2 & z3 \end{bmatrix},$$

so as to perform the error correction, wherein each of the matrix dot elements in the error correction matrix is a set constant.

15. The color management device as claimed in claim 13, further comprising a transition matrix generation module, wherein said transition matrix generation module comprises:

a colorimeter, which is used to measure the red spectral curve IR(λ), green spectral curve IG(λ) and blue spectral curve IB(λ) of the display device, respectively; and a calculation unit, which is used to determine the system transition matrix $$\begin{bmatrix} C_R & C_G & C_B \\ L_R & L_G & L_B \\ M_R & M_G & M_B \end{bmatrix}$$

according to the red spectral curve IR(λ), green spectral curve IG(λ) and blue spectral curve IB(λ).

16. The color management device as claimed in claim 14, further comprising a transition matrix generation module, wherein said transition matrix generation module comprises:

a colorimeter, which is used to measure the red spectral curve IR(λ), green spectral curve IG(λ) and blue spectral curve IB(λ) of the display device, respectively; and a calculation unit, which is used to determine the system transition matrix $$\begin{bmatrix} C_R & C_G & C_B \\ L_R & L_G & L_B \\ M_R & M_G & M_B \end{bmatrix}$$

according to the red spectral curve IR(λ), green spectral curve IG(λ) and blue spectral curve IB(λ).

* * * * *